US008757103B2

(12) United States Patent
Cool

(10) Patent No.: US 8,757,103 B2
(45) Date of Patent: Jun. 24, 2014

(54) HEAT EXCHANGER

(75) Inventor: Peter Jan Cool, Lochem (NL)

(73) Assignee: Inter-Gas Heating Assets B.V., Coevorden (NL)

( * ) Notice: Subject to any disclaimer, the term of this patent is extended or adjusted under 35 U.S.C. 154(b) by 599 days.

(21) Appl. No.: 13/002,494

(22) PCT Filed: Jul. 2, 2009

(86) PCT No.: PCT/NL2009/050392
§ 371 (c)(1),
(2), (4) Date: Jan. 3, 2011

(87) PCT Pub. No.: WO2010/002255
PCT Pub. Date: Jan. 7, 2010

(65) Prior Publication Data

US 2011/0108253 A1 May 12, 2011

(30) Foreign Application Priority Data

Jul. 3, 2008 (NL) ..... 1035654

(51) Int. Cl.
*F22B 37/10* (2006.01)

(52) U.S. Cl.
USPC ..... 122/235.12; 122/367.1; 165/182

(58) Field of Classification Search
USPC ..... 122/367.1, 367.3, 235.12; 165/104.31, 165/104.19, 185, 182, 183, 179
See application file for complete search history.

(56) References Cited

U.S. PATENT DOCUMENTS

| | | | | |
|---|---|---|---|---|
| 2,414,557 | A | 1/1947 | Reed | |
| 4,000,778 | A * | 1/1977 | Laing | 165/86 |
| 4,169,430 | A * | 10/1979 | Cheetham | 122/25 |
| 4,653,572 | A * | 3/1987 | Bennett et al. | 165/133 |
| 5,660,230 | A * | 8/1997 | Obosu et al. | 165/151 |
| 6,223,813 | B1 * | 5/2001 | Chrysler et al. | 165/185 |
| 7,044,211 | B2 * | 5/2006 | Insalaco | 165/183 |
| 7,895,823 | B2 * | 3/2011 | Sciorelli | 60/266 |
| 2009/0218086 | A1 * | 9/2009 | Sciorelli | 165/181 |

FOREIGN PATENT DOCUMENTS

| | | |
|---|---|---|
| EP | 1028298 | 8/2000 |
| GB | 436656 | 10/1935 |
| GB | 499641 | 1/1939 |
| JP | 52-028268 U | 2/1977 |
| JP | 59-049447 A | 3/1984 |
| JP | 59049447 | 3/1984 |
| JP | 03-285751 A | 12/1991 |
| JP | 10-068596 A | 3/1998 |
| JP | 2004-306061 A | 11/2004 |
| JP | 2008-076002 A | 4/2008 |

* cited by examiner

*Primary Examiner* — Gregory A Wilson
(74) *Attorney, Agent, or Firm* — Bozicevic, Field & Francis LLP; Bret E. Field; Daniel G. Stoddard

(57) ABSTRACT

A heat exchanger is manufactured from a single piece of heat-conducting material and comprises fins for guiding a fluid and for transferring heat between the fluid and the heat exchanger, wherein between the fins are provided transverse fins which extend in a direction substantially transversely of the fins over a distance which is less than the distance between the fins and in a direction substantially transversely of the flow direction of the fluid, wherein the transverse fins are arranged alternately close to or on mutually adjacent fins in order to cause a fluid flowing between the fins to follow a meandering path between the fins, wherein the lateral direction lies substantially perpendicularly of the fins.

9 Claims, 3 Drawing Sheets

HEAT EXCHANGER

The present invention relates to a heat exchanger which is manufactured from a single piece of heat-conducting material, comprising fins for guiding a fluid and for transferring heat between the fluid and the heat exchanger.

The present invention further relates to a water heating device for heating water.

The present invention also relates to a combi-boiler for heating tap water and central heating water.

The present invention also relates to a method for manufacturing a heat exchanger.

Heat exchangers are applied in many cooling and heating devices. Known heating devices are for instance a boiler for heating the central heating water (CH water) in a central heating installation (CH installation) and a geyser or boiler for heating tap water.

For space-saving reasons it is advantageous to apply a combined device for heating both the water for the CH installation and the tap water, in the form of a so-called combi-boiler. Because only a single heat generator such as a burner is necessary, space is saved. In addition, the omission of the second burner is advantageous in respect of cost.

A further improvement is the manufacture of the heat exchanger from one piece, whereby the manufacture requires fewer steps.

A heat exchanger can also be made more compact by increasing the heat transfer, whereby a smaller heat exchanger can suffice. It is known to increase the exchange of heat in heat exchangers by enlarging the contact surface of the heat exchangers by providing them with fins.

Despite the above stated improvements there is still a need to make heating and cooling devices more compact and, in addition, to keep the device as simple as possible for economic and technical reasons. The present invention therefore has for its object to provide a heating or cooling device which is more compact than the prior art devices, this without making the device much more complex.

The present invention achieves this object by providing a heat exchanger which is manufactured from a single piece of heat-conducting material, comprising fins for guiding a fluid and for transferring heat between the fluid and the heat exchanger, wherein between the fins are provided transverse fins which extend in a direction substantially transversely of the fins over a distance which is less than the distance between the fins and in a direction substantially transversely of the flow direction of the fluid, wherein the transverse fins are arranged alternately close to or on mutually adjacent fins in order to cause a fluid flowing between the fins to follow a meandering path between the fins, wherein the lateral direction lies substantially perpendicularly of the fins.

In a preferred embodiment the heat exchanger is manufactured from a single piece of metal, for instance aluminium. By applying a casting technique this heat exchanger can thus be manufactured in simple manner.

When such a heat exchanger according to the invention is applied, the fins on the heat exchanger are highly suitable for placing in the flow of a fluid. In that case the fins are placed such that the longitudinal axis of the fins lies in the flow direction of the fluid. The contact surface between fluid and heat exchanger is thus enlarged, as is the transfer of heat between fluid and heat exchanger.

The transverse fins arranged on the fins then ensure that the route travelled by the fluid between the fins is lengthened. In addition, the passage through the fins is made smaller, which results in a higher flow speed of the fluid between the fins. The effects of the longer route travelled by the fluid between the fins and the increased flow speed due to the smaller passage largely cancel each other out. Surprisingly, the degree of heat exchange between fluid and heat exchanger is more strongly affected by the increased flow speed than by the change in the contact surface available for heat exchange. It has thus been found more advantageous, while leaving the overall size of the heat exchanger unchanged, to place the fins further apart and thereby reduce the contact surface in order to arrange transverse fins, which cause a higher flow speed.

In a further advantageous embodiment the heat-exchanging effect is found to be increased still further by increasing the flow speed of the fluid compared to the situation without transverse fins. It is advantageous to enhance the flow speed using a fan. Despite a shorter residence time of the fluid between the fins, more heat is exchanged at a higher flow speed of the fluid in the case the fins are provided with transverse fins when compared to a heat exchanger without transverse fins but with a roughly equal heat-exchanging surface.

In yet another embodiment the transverse fins extend downstream over a larger part of the distance between two mutually adjacent fins than upstream. Downstream the fluid has cooled further and the fluid takes up less volume, whereby the flow speed, and so the heat transfer, would decrease. By reducing the size of the passage downstream by having the transverse fins extend further, it is possible to compensate for this effect and the higher flow speed, and therefore the higher heat transfer, is maintained.

In a further embodiment the heat exchanger according to the invention further comprises a first conduit for guiding a second fluid, which conduit is recessed into the single piece of heat-conducting material of the heat exchanger. The second conduit is highly suitable for respectively cooling and heating the second fluid.

In a specific preferred embodiment heat from the first fluid which runs along the fins of the heat exchanger is transferred particularly via the fins to the heat exchanger. The transverse fins arranged close to the fins are responsible for a greater heat exchange between fluid and heat exchanger in order to enable transfer of the greatest possible amount of heat to the heat exchanger per unit of fluid volume. The heat exchanger will in turn transfer the heat to the second fluid in the conduit. An indirect transfer of heat from the first fluid to the second fluid is hereby realized in efficient manner.

In a specific alternative embodiment the direction of the heat transfer is opposite to the direction as described in the previous embodiment. In this case the second fluid, which flows through the first conduit, relinquishes heat to the heat exchanger. The heat exchanger then heats the first fluid flowing between the fins.

In an advantageous further embodiment the transverse fins are arranged on the fins so that there is sufficient thermal contact between the fins and the transverse fins. This has the additional effect that the transverse fins contribute toward enlarging of the contact surface between the heat exchanger and the first fluid.

In a further embodiment the transverse fins extend in a direction substantially transversely of the fins.

In yet another embodiment the invention provides a heat exchanger, further comprising a second conduit for guiding a third fluid, which conduit is recessed into the single piece of heat-conducting material of the heat exchanger. The advantage of the second conduit is that heat exchange can take place between three fluids. A more specific embodiment, in which this is applied in advantageous manner, is the combi-boiler referred to hereinbelow for heating both CH water and tap water.

In different embodiments the first and second conduits in the heat exchanger take different forms. The conduits preferably define the longest possible route through the heat exchanger in order to realize the longest possible retention time. A better heat exchange is hereby obtained. In order to obtain a compact heat exchanger it is advantageous to embody the conduit not as a single straight passage through the heat exchanger but as a plurality of straight passages connected to each other by bends or, alternatively, a single curved passage. The bends can further be arranged in the heat exchanger itself, although for production engineering reasons it is usually simpler to realize a plurality of straight passages which are mutually connected outside the heat exchanger by bend-shaped pipe pieces.

In a preferred embodiment the present invention provides a heat exchanger, wherein the conduit comprises a hollow guide of a second heat-conducting material, which hollow guide is enclosed substantially close-fittingly by the heat exchanger. Such an embodiment can for instance be manufactured by using a pipe as hollow guide. The heat exchanger is then for instance cast round at least a part of the pipe by placing the pipe in a mould, after which the heat exchanger is formed by filling the mould with for instance a molten metal at a temperature which is lower than the melting point of the pipe. In this way it is also easier to have possible bends in the conduit lie within the heat exchanger.

In a specific embodiment a heat exchanger is provided wherein the transverse fins extend into the space between the fins considerably less far than half the distance between two mutually adjacent fins.

In an alternative embodiment a heat exchanger is provided, wherein the transverse fins extend to a position halfway between adjacent fins in the space between the fins.

In order to create the largest possible contact surface for heat exchange, the heat exchanger must be provided with the greatest possible number of fins. At a given size of the heat exchanger the increase in the number of fins will however result in the fins being placed closer together, whereby the passage between the fins becomes increasingly narrow. If the passage between the fins becomes too narrow, throughflow of the fluid between the fins is adversely affected. Particularly in situations where the fluid is a vapour-containing gas mixture, such as for instance combustion gases, condensation between the fins in the case of too narrow a passage between the fins will impede the throughflow of the fluid. In addition, the chosen technique for manufacturing the heat exchanger with fins also imposes a limit on the distance between the fins. The arranging of transverse fins between the fins further reinforces this effect. For a given design a minimum distance between the fins is thus required in order to still guarantee a good throughflow of the fluid. The presence of transverse fins increases this minimum distance. The further the transverse fins extend in the direction transversely of the fins, the further this minimum distance is also increased. This distance over which the fins extend is thus also limited for practical reasons. Applicant has established with tests that the minimum distance between the fins, less the distance over which the transverse fins extend, amounts to 3 mm. In this case the chosen injection moulding technique was found to be the limiting factor. With a smaller distance the throughflow of the fluid between the fins will however also be adversely affected at a given moment.

In a specific embodiment according to the invention a water heating device for heating water is provided, comprising: a heating element for generating heat; a heat exchanger for absorbing heat generated by the heating element; supply connecting means which are connected to the supply side of the conduit for the fluid cast in the heat exchanger and which can be connected to a supply conduit for water; and discharge connecting means which are connected to the discharge side of the conduit for the fluid cast in the heat exchanger and which can be connected to a discharge conduit for heated water. In an exemplary embodiment the heating element comprises a burner which burns gas. The hot combustion gases are guided along the heat exchanger, and in particular between the fins, whereby the hot combustion gases relinquish heat to the fins, and in this way to the heat exchanger. A water supply which is connected to the supply connecting means supplies water to the conduit in the heat exchanger. The heat from the heat exchanger heats the water in the conduit. The heated water then leaves the conduit in the heat exchanger via a discharge connected to the discharge connecting means.

In a more specific embodiment the water heating device comprises a hot-water heater for tap water. In another embodiment the water heating device comprises a CH boiler for heating CH water for a central heating.

In yet another embodiment the invention provides a combi-boiler for heating tap water and CH water, comprising a hot-water heater, the hot-water heater comprising a heat exchanger, wherein the first conduit is provided for guiding the tap water and the second conduit for guiding the CH water. This embodiment is highly advantageous since prior art combi-boilers generally make use of a three-way valve in order to select whether the heat absorbed by the heat exchanger is used to heat CH water or to heat tap water. By providing the heat exchanger with a conduit for the CH water as well as for the tap water, the three-way valve can be omitted and both CH water and tap water can be heated simultaneously.

According to a further aspect of the invention, a method is provided for manufacturing a heat exchanger, comprising of: providing a mould for manufacturing a heat exchanger from a single piece of heat-conducting material, wherein the mould at least comprises: an opening for receiving a feed of a conduit for casting in for the purpose of guiding a fluid and an opening for receiving a discharge of a conduit for casting in for the purpose of guiding a fluid, and wherein the mould comprises recesses for integral forming of fins on the heat exchanger, and wherein the recesses for the fins are likewise provided with recesses for forming transverse fins on or close to the fins such that the transverse fins extend in a direction substantially transversely of the fins, over a distance which is less than the distance between the fins and in a direction substantially transversely of the anticipated flow direction of the fluid to be allowed to flow between the fins for forming, wherein the transverse fins are arranged alternately close to or on fins for mutually adjacent forming in order to cause a fluid flowing between the fins for forming to follow a meandering path between the fins, wherein the lateral direction lies substantially perpendicularly of the fins; arranging a conduit for guiding a fluid in the mould, wherein the feed of the conduit is received by the opening in the mould for the feed, and the discharge of the conduit is received by the opening in the mould for the discharge; arranging a removable, substantially incompressible core in the conduit for the fluid; filling the mould with at least one heat-conducting material or a material which can at least be converted in the mould to a heat-conducting material; treating the filling of the mould in order to obtain a heat exchanger from a single piece of heat-conducting material; removing the mould from the heat exchanger; and removing the core from the conduit for the fluid.

A suitable process in which to apply this method is for instance an injection moulding process for forming a heat exchanger according to the invention, wherein a molten metal, such as for instance aluminium, is introduced under pressure into the mould with the conduit of for instance copper arranged therein. The liquid metal then solidifies in the mould, whereby the heat exchanger acquires its form, wherein the fins with transverse fins are formed by the shape of the mould.

In another suitable process for this method use is not made of injection-moulding but rather of casting at atmospheric pressure. It will be apparent to the skilled person that the method according to the invention can be applied in any process in which the heat exchanger is formed using a mould. It is for instance possible to envisage filling the mould with a granulate, after which the granulate is brought in the mould to a temperature at which the granulate melts. Once again obtained after cooling and solidifying is a heat exchanger with fins and transverse fins which is manufactured from a single piece. Alternatively, two substances can be introduced into the mould which, optionally after a further treatment, such as for instance a thermal treatment, enter into a reaction with each other whereby a heat exchanger is obtained according to the invention.

Further embodiments and advantages of the present invention are given hereinbelow with reference to the accompanying figures, in which.

Figure 1:
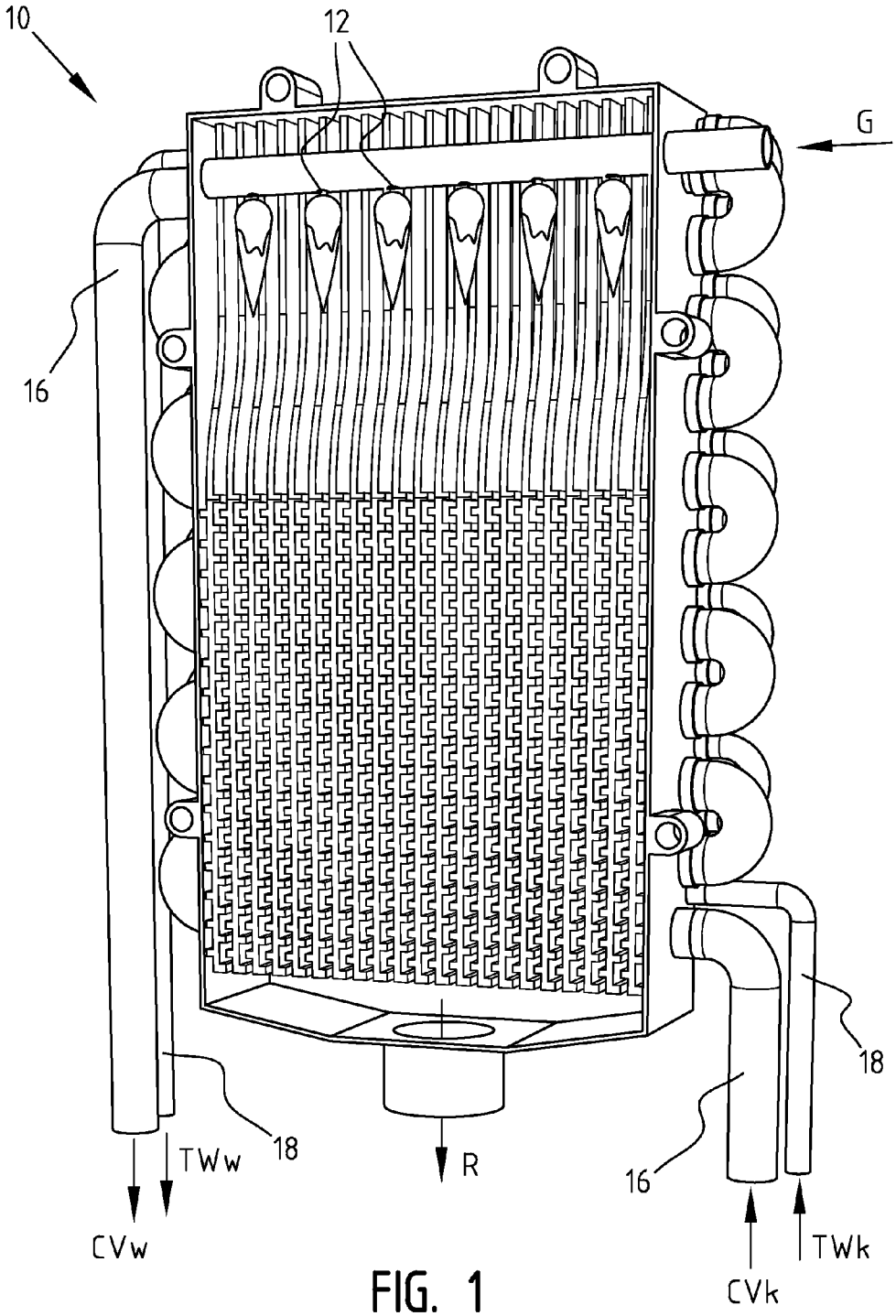
FIG. 1 shows an axonometric view of a heat exchanger according to the present invention provided with supply and discharge conduits for CH water and tap water.

A heat exchanger 10 (FIG. 1) is manufactured from a single piece of aluminium. Heat exchanger 10 is manufactured by means of injection-moulding.

Figure 2:
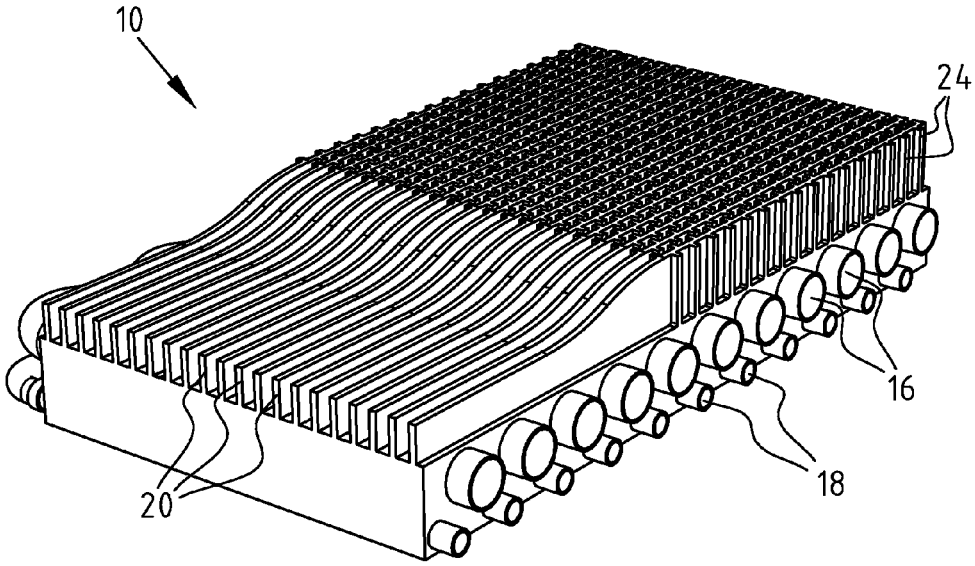
FIG. 2 shows an axonometric view of the heat exchanger of FIG. 1 without external conduits.
Figure 3:
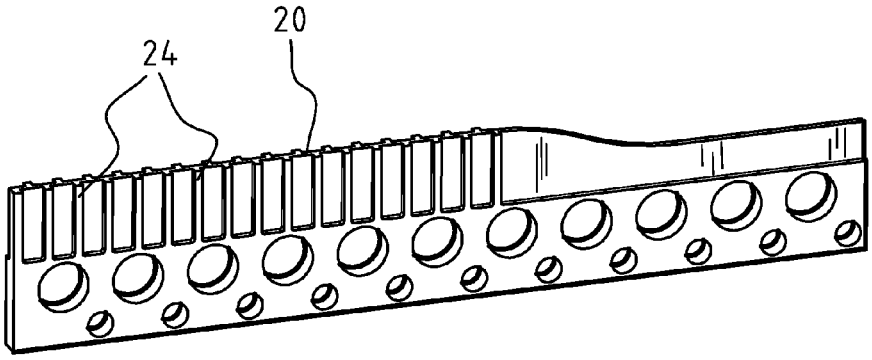
FIG. 3 shows an axonometric view of a "cut-out" fin of the heat exchanger of FIG. 1.

Heat exchanger 10 comprises a number of fins 20 (see also FIGS. 2 and 3). A burner or group of burners 12 is arranged close to heat exchanger 10. Burners 12 are positioned relative to fins 20 such that the hot combustion gases from burner 12 flow along fins 20 and heat is transferred to fins 20, whereby heat exchanger 10 is heated. Fins 20 are provided with transverse fins 24 which lie perpendicularly of fins 20. Transverse fins 24 also lie perpendicularly of the flow direction of the combustion gases. In addition to enlarging the contact surface between combustion gases and heat exchanger 10, transverse fins 24 serve particularly to reduce the passage, whereby the combustion gases acquire a higher flow speed. In addition, they serve to lengthen the route to be travelled by the combustion gases in heat exchanger 10, whereby the retention time of the combustion gases between fins 20 also increases to a small extent without the dimensions of heat exchanger 10 increasing. This measure has the result that a greater amount of heat is transferred from the combustion gases to heat exchanger 10.

In order to avoid as far as possible any possible adverse influence on the flow of the combustion gases around burners 12, transverse fins 24 are not arranged on fins 20 close burners 12. In another embodiment transverse fins 24 are however arranged over the full length of fins 20.

The heat exchanger in the shown embodiment has dimensions of about 500×300×100 mm. The temperature of the combustion gases leaving (R) heat exchanger 10 is a maximum of 70° C. at a water supply temperature of 60° C. and a water discharge temperature of 80° C., and at full load heating operation. By way of comparison: in a similar heat exchanger without transverse fins 24 but with a similar surface area for the purpose of the heat exchange the combustion gases have a temperature of 110° C. when leaving (R) heat exchanger 10. Heat exchanger 10 with transverse fins 24 has absorbed considerably more heat from the combustion gases. The efficiency of the heat exchanger without transverse fins is 96.5% (Hi) at full load CH and water temperature of 60° C. at the feed (of the heat exchanger) and 80° C. at the discharge (of the heat exchanger). The heat exchanger with transverse fins however has an efficiency of 98.0% (Hi). The designation "Hi" indicates that use is made of the lowest calorific value of natural gas in determining efficiency.

Heat exchanger 10 is cast around a first group of conduits 16, these conduits 16 being made of copper. These conduits 16 are intended for guiding CH water through heat exchanger 10 in order to heat the CH water. A second group of conduits 18 is intended for tap water. Conduits 18 of the second group are also made of copper.

Conduits 16 of the first group are mutually connected outside heat exchanger 10 using U-bends so that these conduits together form a long conduit for the CH water. A supply conduit (CVk) for CH water is attached to a first conduit 16 for the purpose of guiding to the heat exchanger the return flow of CH water coming from the CH system of for instance a house. The CH water then runs through first conduit 16 via a U-bend to a second conduit 16 and again via a U-bend to a third conduit 16, and so on, up to the final conduit 16, which is connected to a discharge conduit (CVw). The CH water heated in heat exchanger 10 is sent back into the CH system to the radiators via this discharge conduit (CVw). The circulation of the CH water is generated in known manner by a pump incorporated in this circuit.

Conduits 18 of the second group are connected to each other via U-bends in similar manner as conduits 16 of the first group. A sufficiently long conduit is thus also created for the tap water for the purpose of heating the tap water using the heat absorbed by heat exchanger 10 from the combustion gases coming from burners 12. The tap water enters first conduit 18 via a supply conduit (TWk), which is for instance connected to a public water supply system. The tap water is then guided via a U-bend to a second conduit 18, and so on, until the heated tap water from final conduit 18 leaves the heat exchanger and is guided via a discharge conduit (Tww) to the draw-off points in for instance a house.

The effect of transverse fins 24 is increased by increasing the extent to which transverse fins 24 extend in the space between fins 20. Compare FIGS. 4A and 4B, wherein in FIG. 4A transverse fins 24 extend over a limited part of the distance between mutually adjacent fins 20. In FIG. 4B transverse fins 24 extend further, whereby the meandering route 32 followed by the combustion gases defines a longer path than in FIG. 4A, whereby the retention time between fins 20 is increased. If however transverse fins 24 extend too far, the flow of the combustion gases is obstructed too much.

It is also advantageous to provide a heat exchanger 10 of a determined dimension with the greatest possible number of fins 20 in order to make the contact surface between combustion gases and heat exchanger 10 (via fins 20) as great as possible. Fins 20 here come to lie closer together. If fins 20 come to lie too close together however, the flow of the combustion gases between fins 20 is again obstructed too much, whereby the heat exchanger transfers less heat. Compare FIG. 4C to FIGS. 4A and 4B.

The effect of the heat exchanger is greatest in FIG. 4B. In this figure the passage amounts to 50% and, in addition, the path travelled is the longest. The effect is smallest in FIG. 4A.

Figure 4C:
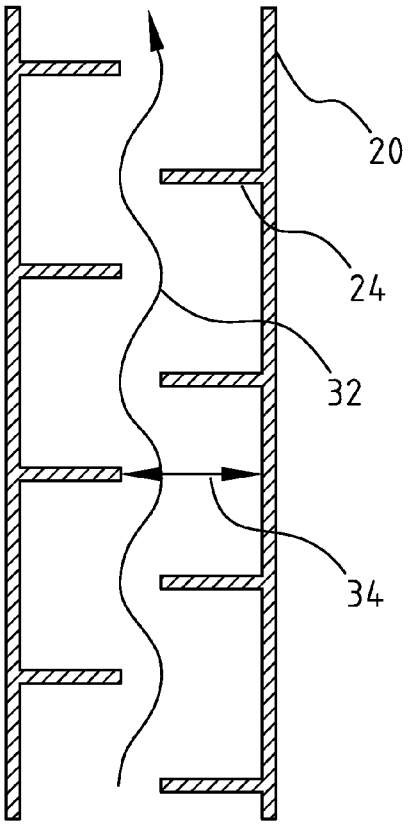
FIGS. 4A-4C show schematic representations of three configurations of the transverse fins according to the invention.
Figure 4B:
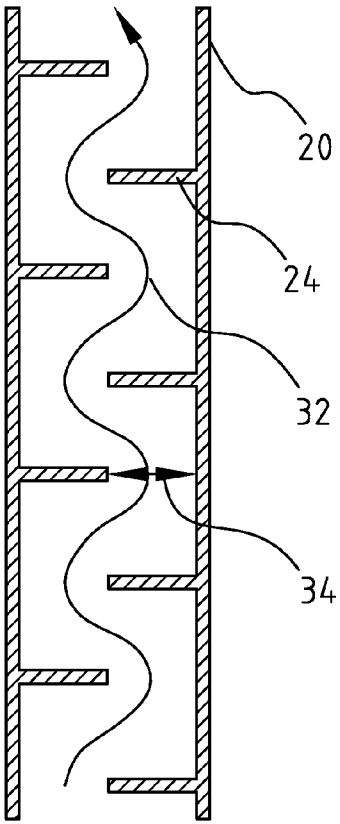
Figure 4A:
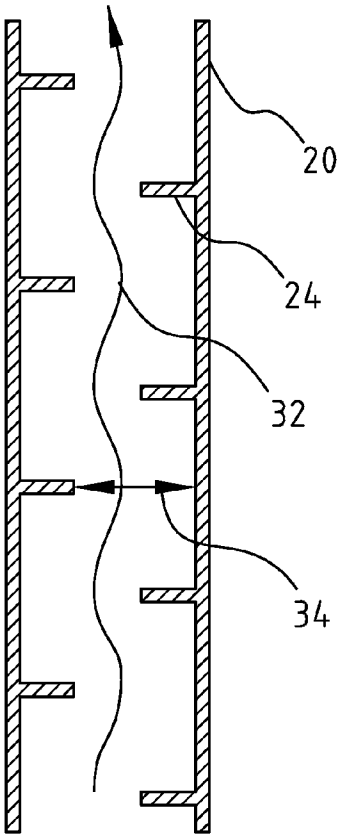

The passage in FIG. 4A is smaller than in FIG. 4C (and FIG. 4B) and the path travelled is the same as the path travelled in FIG. 4C.

Applicant has established with tests that a minimum space of 3 mm between a fin 20 and a transverse fin 24 is necessary in order not to obstruct the flow of the combustion gases too much.

The embodiments discussed in this description and shown in the drawings are only given by way of example. It will be apparent to the skilled person that many modifications and changes are possible within the scope of the present invention. It will also be apparent to the skilled person that the given and shown embodiments can be combined in order to obtain new embodiments according to the invention. The protection sought is therefore defined by the following claims.

FIGURES

10—heat exchanger
12—burners
14—combustion gases
16—CH water conduit
18—tap water conduit
20—fins
24—transverse fins
32—flow direction fluid
34—diameter fluid passage

The invention claimed is:

1. A heat exchanger which is manufactured from a single piece of heat-conducting material, comprising fins configured for guiding a fluid in a flow direction from a burner or group of burners arranged close to the heat exchanger at one end thereof to an opposite end where combustion gases leave the heat exchanger, and for transferring heat between the fluid and the heat exchanger, wherein between the fins are provided transverse fins which extend in a direction substantially transversely of the fins over a distance which is less than the distance between the fins and in a direction substantially transversely of the flow direction of the fluid, wherein the transverse fins are arranged alternately close to or on mutually adjacent fins in order to cause a fluid flowing between the fins to follow a meandering path between the fins, wherein the transverse direction lies substantially perpendicular to the fins.

2. The heat exchanger as claimed in claim 1, further comprising a first conduit for guiding a second fluid, which conduit is recessed into the single piece of heat-conducting material of the heat exchanger.

3. The heat exchanger as claimed in claim 2, further comprising a second conduit for guiding a third fluid, which conduit is recessed into the single piece of heat-conducting material of the heat exchanger.

4. The heat exchanger as claimed in claim 2, wherein the conduit comprises a hollow guide of a second heat-conducting material, which hollow guide is enclosed substantially close-fittingly by the heat exchanger.

5. The heat exchanger as claimed in claim 1, wherein the transverse fins extend into the space between the fins considerably less far than half the distance between two mutually adjacent fins.

6. The heat exchanger as claimed in claim 1, wherein the transverse fins extend to a position halfway between adjacent fins in the space between the fins.

7. A water heating device for heating water, comprising: a heating element for generating heat; a heat exchanger as claimed in claim 1 for absorbing heat generated by the heating element; supply connecting means which are connected to the supply side of the conduit for the fluid cast in the heat exchanger and which can be connected to a supply conduit for water; and discharge connecting means which are connected to the discharge side of the conduit for the fluid cast in the heat exchanger and which can be connected to a discharge conduit for heated water.

8. A combi-boiler for heating tap water and CH water, comprising a hot-water heater as claimed in claim 7, wherein the heat exchanger further comprises a first conduit for quidinq a second fluid, which conduit is recessed into the single piece of heat-conducting material of the heat exchanger; and wherein the heat exchanger further comprises a second conduit for quidinq a third fluid, which conduit is recessed into the single piece of heat-conducting material of the heat exchanger, wherein the first conduit is provided for guiding the tap water and the second conduit for guiding the CH water.

9. A method for manufacturing a heat exchanger, comprising of: providing a mould for manufacturing a heat exchanger from a single piece of heat-conducting material, wherein the mould at least comprises:

an opening for receiving a feed of a conduit for casting in for the purpose of guiding a fluid, and an opening for receiving a discharge of a conduit for casting in for the purpose of guiding a fluid, and wherein the mould comprises recesses for integral forming of fins on the heat exchanger, and wherein the recesses for the fins are likewise provided with recesses for forming transverse fins on or close to the fins such that the transverse fins extend in a direction substantially transversely of the fins, over a distance which is less than the distance between the fins and in a direction substantially transversely of the anticipated flow direction of the fluid to be allowed to flow between the fins for forming, wherein said flow direction is directed from a burner or group of burners arranged close to the heat exchanger at one end thereof to an opposite end where combustion gases leave the heat exchanger, wherein the transverse fins are arranged alternately close to or on fins for mutually adjacent forming in order to cause a fluid flowing between the fins for forming to follow a meandering path between the fins, wherein the transverse direction lies substantially perpendicular to the fins;

arranging a conduit for guiding a fluid in the mould, wherein the feed of the conduit is received by the opening in the mould for the feed, and the discharge of the conduit is received by the opening in the mould for the discharge;

arranging a removable, substantially incompressible core in the conduit for the fluid;

filling the mould with at least one heat-conducting material or a material which can at least be converted in the mould to a heat-conducting material;

treating the filling of the mould in order to obtain a heat exchanger from a single piece of heat-conducting material;

removing the mould from the heat exchanger; and removing the core from the conduit for the fluid.

* * * * *